United States Patent [19]

Santo

[11] Patent Number: 4,689,843

[45] Date of Patent: Sep. 1, 1987

[54] DECORATIVE COVER FOR A FLOATATION SLEEP SYSTEM

[76] Inventor: Philip J. Santo, 12 Mountin Rd., Rochester, N.Y. 14625

[21] Appl. No.: 902,776

[22] Filed: Sep. 2, 1986

[51] Int. Cl.[4] ..... A47C 27/08

[52] U.S. Cl. ..... 5/452; 5/451

[58] Field of Search ..... 5/451, 452, 450, 455, 5/457, 482, 485, 497

[56] References Cited

U.S. PATENT DOCUMENTS 4,062,077 12/1977 Autrey et al. ..... 5/451

4,193,151 3/1980 Calleance ..... 5/452

*Primary Examiner*—Alexander Grosz

*Attorney, Agent, or Firm*—Lawrence P. Kessler

[57] ABSTRACT

A decorative cover, for use with a floatation sleep system, adapted to contain a fluid-filled bladder, and functional to establish and maintain a substantially rectilinear shape for such fluid-filled bladder. The decorative cover comprises first and second flexible, substantially rectangular, dimensionally stable sheets. The second dimensionally stable sheet has an opening defined therein adapted to have a floatation sleep system bladder inserted therethrough. The marginal edges of the first and second sheets are interconnected by a perimeter wall member member. A first dimensionally stable tie member joins the first sheet to the connecting wall member and is disposed interiorly of the interconnection between the first sheet and the connecting wall member; and a second dimensionally stable tie member joins the second sheet to the connecting wall member and is disposed interiorly of the interconnection between the second sheet and the connecting wall member. Accordingly, the first and second tie members respectively prevent said first and second sheets from moving away from the connecting wall member due to forces exerted by a fluid-filled bladder contained therewithin. The first and second tie members may respectively form first and second chambers with the first and second sheets and the connecting wall member, such chambers being adapted to contain a compressible medium such as foam or pressurized air for example.

4 Claims, 4 Drawing Figures

DECORATIVE COVER FOR A FLOATATION SLEEP SYSTEM

BACKGROUND OF THE INVENTION

This invention relates generally to floatation sleep systems, and more particularly to a decorative cover for a floatation sleep system, such cover giving the floatation sleep system a substantially overall rectilinear shape.

Floatation sleep systems, commonly referred to as waterbeds, have become a popular alternative to conventional bedding. Such popularity is due to the fact that waterbeds provide totally balanced body support by the sleep surface which has been found to induce a superior state of relaxation. The first waterbeds were free standing, flexible bladders filled with water. However, since the free standing bladder was flexible in all directions, it was necessary that it have sufficient vertical dimension (height) to prevent "bottoming out" when a body was supported on the bladder. This height made it awkward to get on and off of the bladder, and the fact that the side walls of the bladder were flexible made sitting on the edge difficult and uncomfortable. Therefore, a rigid frame located around the marginal perimeter edges of the flexible bladder were added. While the frame supported the edges of the bladder so that a sufficient height was maintained in to prevent bottoming out, sitting on the edge of the bladder and getting in and out of the waterbed over the rigid frame was still uncomfortable.

In order to provide the advantages of a rigid frame to the waterbed while improving the comfort thereof, the rigid frame was replaced by an air chamber surrounding the marginal perimeter edges of the flexible bladder (see for example, U.S. Pat. Nos. 3,778,852, issued Mar. 21, 1978 in the name of Penn et al, and 4,070,473, issued Dec. 18, 1983 in the name of Philips). The marginal perimeter air chamber provided the desireable comfort when entering and exiting the waterbed and when sitting on the edge thereof, and in addition supported the marginal perimeter of the bladder at a height which prevented the bladder from bottoming out.

More recently, I have improved the marginal perimeter supporting air chamber type floatation sleep system by separating the water-containing bladder from the perimeter supporting air chamber (see my U.S. Pat. No. 4,513,463, issued Apr. 30, 1985). By my patented arrangement, bladders or marginal perimeter supporting chambers may be selectively replaced when damaged, or whenever a change in the bladder or chamber characteristics is desired. As with other typical floatation sleep systems including marginal perimeter supporting air chambers however, the side walls of the air chambers are rounded in cross-section due to the nature of the chamber construction and the air pressure therewithin. This has, in some instances, proven to be a drawback to users who prefer the overall rectilinear appearance of conventional bedding. In my U.S. patent applications Ser. No. 782,938, filed Oct. 2, 1985, and Ser. No. 902,777 filed Sept. 2, 1986, I have attempted to provide such desired rectilinear appearance to marginal perimeter supporting air chambers. However, the chambers disclosed in such applications are limited in use to floatation sleep systems which include marginal perimeter supporting air chambers.

SUMMARY OF THE INVENTION

This invention is directed to a decorative cover, for use with a floatation sleep system, adapted to contain a fluid-filled bladder, and functional to establish and maintain a substantially rectilinear shape for such fluid-filled bladder. The decorative cover comprises first and second flexible, substantially rectangular, dimensionally stable sheets. The second dimensionally stable sheet has an opening defined therein adapted to have a floatation sleep system bladder inserted therethrough. The marginal edges of the first and second sheets are interconnected by a perimeter wall member. A first dimensionally stable tie member joins the first sheet to the connecting wall and is disposed interiorly of the interconnection between the first sheet and the connecting wall; and a second dimensionally stable tie member joins the second sheet to the connecting wall and is disposed interiorly of the interconnection between the second sheet and the connecting wall. Accordingly, the first and second tie members respectively prevent the first and second sheets from moving away from the connecting wall due to forces exerted by a fluid-filled bladder contained therewithin. The first and second tie members may respectively form first and second chambers with the first and second sheets and the connecting wall, such chambers being adapted to contain a compressible medium such as foam or pressurized air for example.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 4:
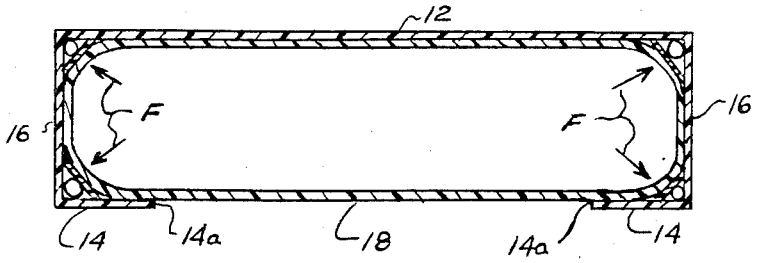
FIG. 4 is a side elevational view, in cross-section, of the decorative cover in relation to an exemplary floatation sleep system, particularly depicting the forces which enable the cover according to this invention to give the floatation sleep system an overall rectilinear shape.

Referring now to the accompanying drawings, a decorative cover according to this invention, designated generally in the drawings by the numeral 10, is shown which has the ability to give any type of floatation sleep system a substantially rectilinear appearance. The decorative cover includes a first flexible, substantially rectangular, dimensionally stable sheet 12. The sheet 12 may be formed of polyethylene, for example, although any similar type material would be suitable for use with this invention. The material may have any desire decorative appearance. A second sheet 14, formed of a similar material, is connected to the first sheet by a perimeter wall member 16 which joins the first and second sheets at their respective marginal perimeter edges forming sharp rectilinear corners therebetween. The perimeter wall member 16 is also formed of such similar material. Forming the sheets 12, 14 and the member 16 of similar material enables them to be readily joined, such as by heat sealing for example. The second sheet has a large opening 14a defined therein which enables a floatation sleep system bladder 18 to be inserted therethrough (see FIG. 4). Of course, the bladder 18 as shown is only exemplary of the types of floatation sleep systems with which the decorative cover 10 of the present invention is capable of being associated (for example, the floatation sleep system may include a marginal perimeter support chamber). Further, by inverting the cover 10, it may serve the additional function of a typical floatation sleep system liner.

Figure 1:
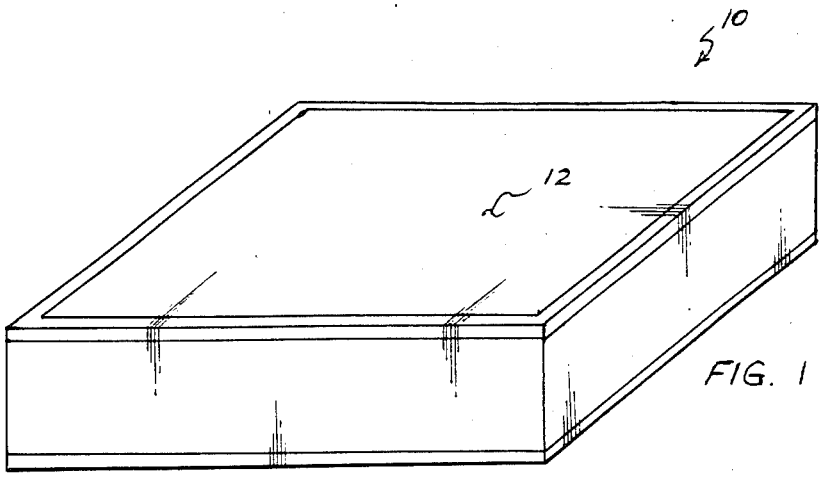
FIG. 1 is a view, in perspective, of the decorative cover for a floatation sleep system, according to this invention.
Figure 2:
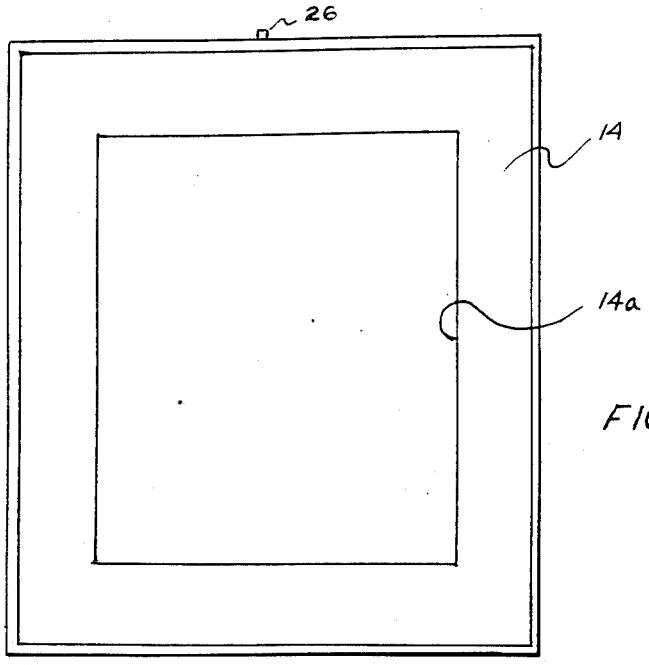
FIG. 2 is a bottom plan view of the decorative cover of FIG. 1.
Figure 3:
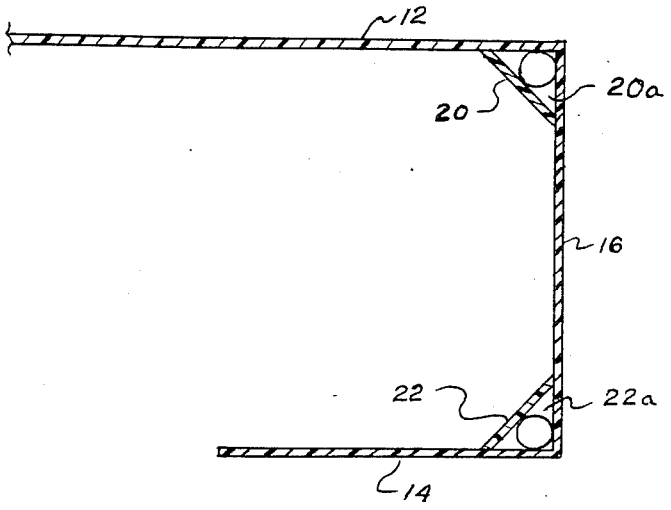
FIG. 3 is a side elevational view, in cross-section and on an enlarged scale, of a portion of the decorative cover of FIG. 1.

As best seen in FIG. 3, a first tie member 20, formed of a material similar to that of the sheets and wall member, joins the first sheet 12 to the perimeter wall member 16 and is disposed interiorly of the interconnection between the first sheet and the perimeter wall member. Likewise, a second tie member 22, formed of a similar material, joins the second sheet 14 to the perimeter wall member 16 and is disposed interiorly of the interconnection between the second sheet and the perimeter wall member. The tie members 20 and 22 serve to counteract the forces F exerted by the fluid-filled bladder on the first and second sheets and the perimeter wall member to prevent the first and second sheets from moving away from the perimeter wall member. Accordingly, the sharp corners formed at the interconnection of the marginal edges of the first and second sheets with the perimeter wall member are retained, and the overall substantially rectilinear configuration is maintained.

If the tie members 20, 22, are attached to the first and second sheets and the perimeter wall member member by heat sealing for example, first and second closed chambers **20*a* and 22*a* are respectively formed between the tie members and the first and second sheets and the perimeter wall member. The chambers 20*a* and 22*a* may be adapted to contain a compressible medium which furter serves to maintain the sharpness of the corners, and thus the rectilinear shape of the cover. The compressible medium may be foam; or if suitable valves 26** are provided in communication with the interior of the chambers, the compressible medium may be pressurized air.

The invention has been described in detail with particular reference to a preferred embodiment thereof, but it will be understood that variations and modifications can be effected within the spirit and scope of the invention.

I claim:

1. For use with a floatation sleep system including a fluid-filled bladder, a decorative cover adapted to contain a fluid-filled bladder and functional to maintain a substantially rectilinear shape for such fluid-filled bladder, said cover comprising:

a first flexible, substantially rectangular, dimensionally stable sheet;

a second flexible, substantially rectangular, dimensionally stable sheet, said second sheet having an opening defined therein and adapted to have a floatation sleep system bladder inserted therethrough;

means for interconnecting the marginal perimeter edges of said first and second sheets; and a first dimensionally stable tie member joining said first sheet to said interconnecting means and disposed interiorly of the interconnection of said first sheet and said interconnecting means, and a second dimensionally stable tie member joining said second sheet and said interconnecting means and disposed interiorly of the interconnection of said second sheet and said interconnecting means, whereby said first and second tie members respectively form first and second chambers with said first and second sheets and said interconnecting means, said first and second chambers being adapted to contain a compressible medium, and wherein said first and second tie members respectively prevent said first and second sheets from moving away from said interconnecting. means due to forces exerted by a fluid-filled bladder contained therewithin.

2. The invention of claim 1 wherein said compressible medium is pressurized air.

3. The invention of claim 2 further including means for selectively admitting pressurized air into said first and second chambers.

4. The invention of claim 1 wherein said compressible medium is foam.

* * * * *